US005190092A

United States Patent [19]

Revankar

[11] Patent Number: 5,190,092

[45] Date of Patent: Mar. 2, 1993

[54] METHOD OF IMPREGNATION OF IRON WITH A WEAR-RESISTANT MATERIAL

[75] Inventor: Gopal S. Revankar, Moline, Ill.

[73] Assignee: Deere & Company, Moline, Ill.

[21] Appl. No.: 564,184

[22] Filed: Aug. 8, 1990

[51] Int. Cl.[5] ..... B22D 19/00

[52] U.S. Cl. ..... 164/97; 164/10; 164/112

[58] Field of Search ..... 164/34, 35, 97, 9, 10, 164/11, 112

[56] References Cited

U.S. PATENT DOCUMENTS

| | | | |
|---|---|---|---|
| 1,057,069 | 3/1913 | MacDonald | 164/10 |
| 1,978,319 | 10/1934 | Mowery | 164/112 |
| 2,303,046 | 11/1942 | Havlick | 164/112 |
| 4,024,902 | 5/1977 | Baum . | |
| 4,774,991 | 10/1988 | Holden | 164/97 |

FOREIGN PATENT DOCUMENTS

| | | | |
|---|---|---|---|
| 0280830 | 9/1988 | European Pat. Off. . | |
| 1508887 | 3/1970 | Fed. Rep. of Germany . | |
| 2723353 | 11/1978 | Fed. Rep. of Germany . | |
| 51-25211 | 7/1976 | Japan | 164/97 |
| 58-209466 | 12/1983 | Japan | 164/97 |
| 59-76656 | 5/1984 | Japan | 164/112 |

*Primary Examiner*—Kurt C. Rowan
*Assistant Examiner*—Rex E. Pelto
*Attorney, Agent, or Firm*—Burns, Doane, Swecker & Mathis

[57] ABSTRACT

A method for impregnating an iron product with a hard wear-resistant material surface layer comprises providing a pattern of particles onto a high temperature adhesive layer on a sand core and casting of the iron melt around the particles so as to produce an iron product. Preferably, the pattern of particles is produced by providing a mesh plate having a desired pattern of holes and spreading the particles onto the sheet. The pattern of particles is then transferred on to the adhesive layer so as to minimize contact with the adhesive. This can be accomplished, for example, through the use of adhesive tape. Preferably, the iron product of the present invention comprises ductile iron while the wear-resistant material comprises tungsten carbide which can include about 12 wt % Co.

16 Claims, 2 Drawing Sheets

METHOD OF IMPREGNATION OF IRON WITH A WEAR-RESISTANT MATERIAL

BACKGROUND OF THE INVENTION

The present invention relates to a process for the impregnation of an iron product with a surface comprising a hard wear-resistant material.

A wide variety of techniques are known for the impregnation of iron with a hard wear-resistant surface. Such techniques include flame spray coating and plasma spray coating. However, each of these spray coating techniques suffer from problems associated with the spalling of surface layers during the coating process and during service as well as the particularly large expense associated with the use of these techniques.

Cast-In-Carbides are also known in which carbide particulates are placed within a mold and molten iron is then cast. See, for example, the discussion within U.S. Pat. No. 4,119,459 to Ekemar et al. It is difficult, however, with such castings to accurately maintain the carbide particles in the desired location and in a regular distribution pattern.

In addition, certain cast-on hard surfacing techniques for use with polystyrene patterns are also known in the art. See, for example, the discussion in Hansen et al, "Application of Cast-On Ferrochrome-Based Hard Surfacings to Polystyrene Pattern Castings," Bureau of Mines Report of Investigations 8942, U.S. Department of the Interior, 1985.

With the process discussed in Hansen et al, a paste comprising a binder and the desired hard material, such as tungsten carbide powder, is applied to those surfaces of a polystyrene pattern which correspond to wear-prone surfaces of the resulting casting. A refractory coating is then applied on the entire pattern prior to casting the metal, the process being known as "evaporative pattern casting" process or EPC process.

However, this process suffers from problems associated with the low reliability of the bond formed between the wear resistant layer, e.g., tungsten carbide, and the foam pattern which is predominantly caused by the failure of the nearly dry paste to wet the foam surface sufficiently. Because of this failure, sometimes the iron does not penetrate the layer before the iron solidifies and, thus, instead of impregnating the iron, the carbide spalls off the product.

This process is also complex and inefficient and thus cannot be effectively employed for large scale production.

In addition, the prior art methods are particularly unsuitable for the production of a wear resistant layer of larger thicknesses. In particular, if larger thicknesses are employed in prior art processes, liquid metal penetration becomes difficult to achieve. Thus, the carbide particles are not trapped by the metal and they tend to spall off.

It is known iron castings made by EPC process have lower mechanical properties than sand (or core) cast products due to presence of carbon defects. Also the EPC process requires special care to minimize distortions in castings.

Accordingly, the need still exists for a method of impregnating iron surfaces with a hard wear-resistant material, particularly when employing larger size particles, to produce larger thicknesses.

SUMMARY OF THE INVENTION

In one aspect of the present invention, there is disclosed a method for impregnating an iron product with a hard wear-resistant material surface layer comprising:

(a) providing a mesh plate having a desired pattern of holes of a predetermined size;

(b) spreading particles onto the mesh plate so as to provide a particle in substantially all of the holes;

(c) providing a sand core having a desired shape which has a layer of adhesive on at least a portion thereof;

(d) transferring the pattern of particles onto the adhesive layer in a manner which would minimize contact with the adhesive;

(e) curing the adhesive so as to anchor the particles to the sand core; and (f) casting an iron melt around the carbides so as to produce an iron product having a wear resistant material surface layer.

This process can further comprise (g) cooling the product and separating both the adhesive and the core from the iron product; and (h) finishing the wear resistant surface.

In another embodiment, the particles are transferred through the use of an adhesive tape which is placed on the mesh plate after step (b) and then placed on the adhesive layer in step (d) and removed after step (e).

In another aspect of the present invention, the product produced by the above process is provided.

DETAILED DESCRIPTION OF THE PREFERRED EMBODIMENTS

Figure 1A:
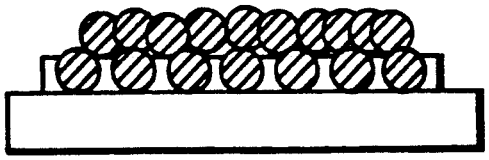
FIGS. 1*a–d* illustrates a technique for forming a particle pattern.

The present invention can be employed for the casting of any type of iron which is known in the art. However, cast iron and, in particular, ductile or gray iron are preferred.

In the present invention, larger particles of the hard wear-resistant material is preferably employed, i.e., those particles having a size of from about 2 mm or more. More preferably, the particle size employed in the present invention is from about 2 to about 3 mm. Moreover, the size of all the particles in a given bulk is preferably within about 0.5 mm of the median size.

However, it is also apparent that the use of particles having different sizes can be made to produce layers having a controlled, desired thickness at various points on the final product.

The particles are also preferably substantially spherical for ease of use and other practical considerations, although the shape is not particularly critical to the present invention.

As to the choice of the hard wear-resistant material, the present invention can effectively employ any of the hard phases which are traditionally employed in the art, such as tungsten carbide, chromium carbide, and the like, or mixtures thereof. Furthermore, this material can include a binder metal, such as those in the Fe group, preferably Co for use with tungsten carbide, or nickel for chromium carbide, etc., which may be necessary to produce the preferred spherical shapes.

It has been found that the use of a wear-resistant material which has adequate wettability with respect to the iron casting employed is effective in decreasing the spalling problem associated with prior art castings. Thus, where ductile iron is employed as the metal to be cast, particles comprising tungsten carbide with 12 wt % Co is particularly preferred.

A high temperature inorganic adhesive is preferred as the adhesive in order to prevent the premature release of the carbides from the core. By high temperature, it is meant that the adhesive has a melting point higher than the iron pouring temperature. Any suitable adhesive can be employed in the present invention. In a preferred embodiment, the binder comprises a high temperature ceramic adhesive, AREMCO's Ceramabond 569, which is a proprietary high temperature binder that includes oxides of Al, Si, K in a colloidal suspension in water, and which has a maximum use temperature of about 1650° C. (Ceramabond is a trademark of Aremco Products, Inc.). Examples of other adhesives which can be used include those high temperature inorganic adhesives made by other manufacturers, e.g., Cotronics Corporation.

The process of the present invention is used to provide a casting with the wear-resistant material at a particular place (or places) of the casting utilizing an air set (no bake) sand core. The sand core having a particular shape and size (which is dependent upon the ultimate cast product desired) may be produced by any known method. In particular, certain efficacious methods for forming sand cores are illustrated within ASM Metals Handbook, Volume 5, 8th Edition.

Preferably, by the process of the present invention a single layer of particles is provided on an adhesive layer which has been applied to the core surface. Because the adhesive film on the particle prevents the wetting of the carbide by the molten metal, there should be a minimum area contact, preferably a single point contact, between the particle and the adhesive during binding to the core. Furthermore, the particles are preferably uniformly distributed on the core, i.e., without near neighbor contact, to allow easy metal and slag flow around each particle and thus form a good quality composite, the slag being formed due to interaction between carbides, molten metal and high temperature adhesive.

In order to perform the above objectives, the following procedures can be employed. A mesh plate, e.g., a sheet having a desired pattern of holes, is provided. Preferably, the mesh plate has a hexagonal pattern of holes in order to provide the optimal packed arrangement. Moreover, the mesh plate thickness is preferably selected to be less than the median particle diameter, more preferably between about ½ and about ¾ of the median particle diameter so that the particles protrude slightly above the mesh plate. In particular, this mesh plate can be provided by any suitable means, e.g., drilling holes, in a steel or a plastic (e.g., polycarbonate) sheet, having the desired thickness.

Figure 1B:
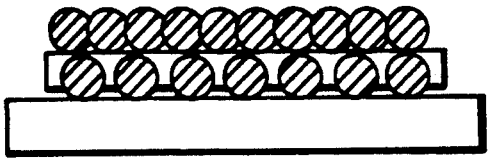
Figure 1C:
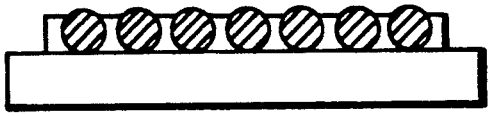
Figure 1D:
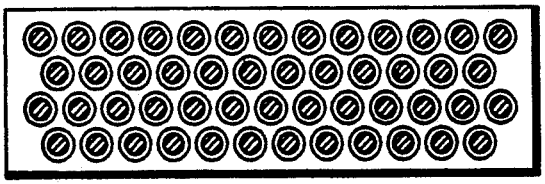

After the mesh plate is placed on a flat surface of a support plate, e.g., a steel plate or the like, the particles are then spread on the mesh plate and the excess particles are removed. See, for example, FIG. 1*a*. This removal can be accomplished by any satisfactory method, for example, by raising the mesh plate through a height approximately equal to the particle radius and scraping off the excess particles. See, for example, FIG. 1*b*. The mesh plate can then be lowered on to the flat surface of the support plate so that the top of the particles will protrude above the top surface of the mesh plate, thus, forming a geometric pattern of particle distribution. See, for example, FIG. 1*c* and *d*.

The adhesive layer is applied to the sand core at those locations where the wear resistant layer is to be provided. The adhesive layer can be applied to the sand core by any suitable means, e.g., painting or spraying. Moreover, the adhesive layer preferably has a thickness of at least about 0.1 mm, more preferably about 0.1 to 0.5 mm, still more preferably 0.2 to 0.5 mm.

Figure 2:
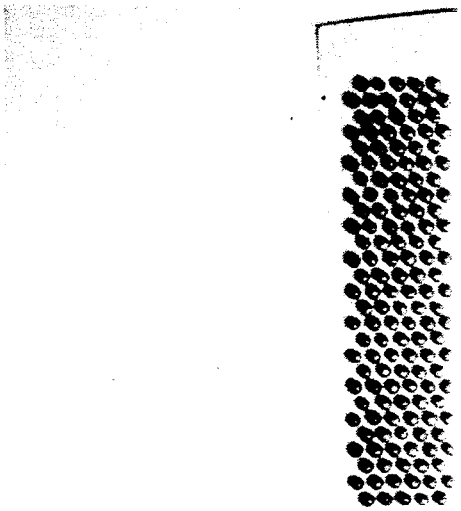
FIGS. 2–4 are photographs illustrating various aspects of the present invention.

The particles which are arranged in a geometrical pattern as described above, are then transferred to the adhesive layer on the sand core. In one embodiment, an adhesive tape is placed on the particle pattern. When the adhesive tape is removed, the geometric pattern of particles is effectively transferred to the tape. See, for example, FIG. 2.

The tape which can be employed in the present invention includes any tape which is strong enough to hold heavy, i.e., high density, carbides firmly in place and yet weak enough to release the particles when the tape is lifted off the carbide strip after curing of the adhesive. Examples of such tape include 3M 404 type tape with high tack rubber adhesive, and 3M 9415 or Y928 low tack tapes with acrylic type adhesives.

The tape is then placed on the adhesive layer so that the carbide particles make minimum contact with the adhesive. The tape may be moved without disturbing the particle arrangement or increasing the adhesive/-particle contact area until the adhesive has not cured. This freedom allows precise location of the tape onto the core. Hot air may be blown for a sufficient period of time, e.g., 25–30 seconds onto the tape in order to allow the adhesive to be sufficiently dry to hold it in place, and allow handling the core without disturbing particle arrangement.

In addition, in an alternative embodiment, if a polymer sheet, e.g., polycarbonate sheets with mesh patterns, such as those manufactured by Plascore, Inc., are employed, they are flexible enough to be used for carbide distribution directly on a core without using a tape. In this alternate process, adhesive is applied to the core surface, the mesh sheet is placed on the adhesive layer, particles are spread on the mesh sheet and mesh sheet is lifted off core surface after the adhesive is cured. Mesh size is chosen such that only one particle can enter a given mesh. However, if large or complex surfaces are to be produced, the tape method is preferred.

Figure 3:
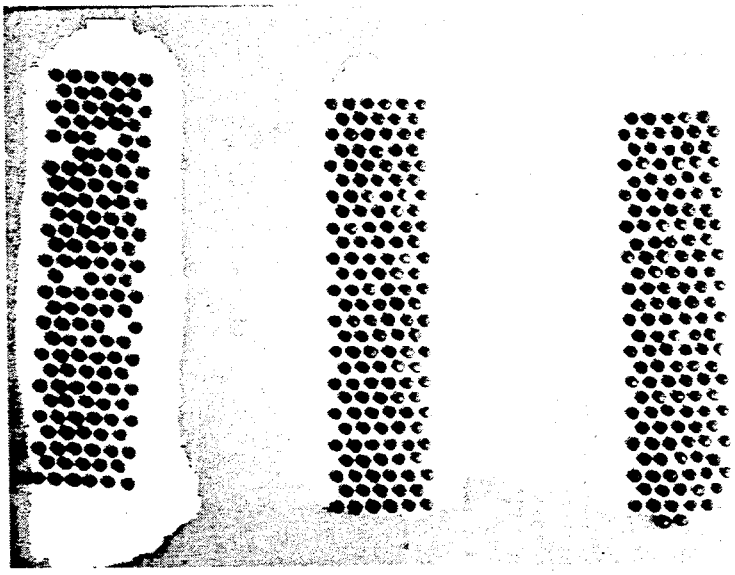

After the particles are transferred, the adhesive is cured. If, for example, Ceramabond 569 is employed as the adhesive, this curing can occur at room temperature in 16 hours or at 50° C. in 8 hours. When the adhesive is cured, the tape can be removed leaving a pattern of carbide particles firmly anchored to the sand core surface. See, for example, FIG. 3.

At this point the liquid iron is cast around the carbide through any of the casting techniques traditionally employed in the art, e.g. gravity feed casting, squeeze casting, vacuum casting, or etc. However, due to ease of use, the gravity feed of metal is preferred. In casting of the metal, it has been found that the use of surface reduced carbide particles, e.g., particles which are subjected to a hydrogen reduction treatment, improves particle-to-metal bonding and eliminates or minimizes any carbide loss during casting.

Figure 4:
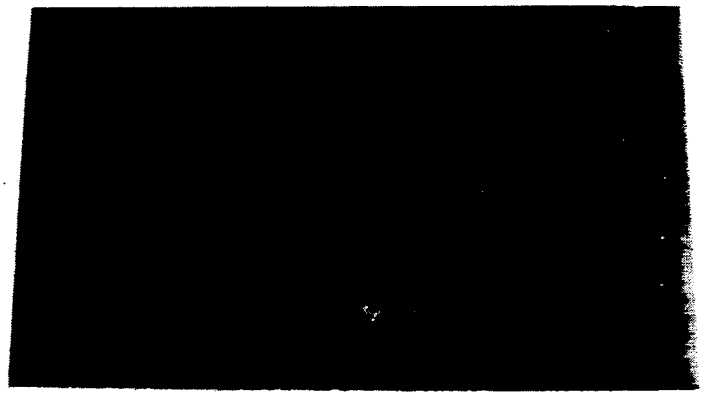

Exemplary ductile iron casting with tungsten carbide impregnation are illustrated in FIG. 4.

The method according to the present invention can be used to make iron products which have a wide variety of applications. In particular, the procedure can be used for making complex components with wear surfaces such as a rotor housing. Moreover, this can be accomplished at a greatly reduced cost when compared to prior art systems.

In addition to the ease associated with various aspects of the present invention, e.g., the use of sand cores, the use of adhesive tapes which allow application to a variety of curved and complex core surfaces, the use of geometric, regular particle arrangements which aid in assuring particle entrapment by the metal, the method of the present invention can provide a composite with uniform tribological characteristics over the entire composite surface.

In order to further illustrate the present invention and the advantages associated therewith, the following specific example is given, it being understood that same is intended only as illustrative and in nowise limitive.

EXAMPLE

A powder consisting of spherical particles having a median diameter of about 2 mm and whose diameters do not vary from the median by more than 0.5 mm is spread on a mesh plate having hexagonal pattern of holes which is placed on a support plate. The plate thickness is slightly greater than the median particle radius.

The mesh plate is raised above a support steel plate to a height approximately equal the particle radius and the excess particles are scraped off. The mesh plate is then lowered back onto the support plate so that the top of the particles protrude above the top surface of the mesh plate.

Adhesive tape comprising 3M 404 type tape with high tack rubber adhesive is placed on the particle pattern, pressed lightly and lifted off to transfer the particle pattern to the tape.

An adhesive layer of approximately 0.1 to 0.25 mm thickness comprising Ceramabond 569 is painted onto a sand core of the desired shape and the tape is placed thereon so as to make single point contact with the adhesive.

The adhesive is cured for 8 hours at 50° C. and the tape peeled off after the core is cooled, preferably, to room temperature.

The liquid iron is cast around the carbide particles to produce a casting having a composite layer.

After the casting is cooled, the high temperature adhesive along with the core is easily separated from the carbides in the casting surface.

While this invention has been described in terms of various preferred embodiments, the skilled artisan will appreciate the various modifications, substitutions, omissions and changes which may be made without departing from the spirit thereof. Accordingly, it is intended that the scope of the present invention be limited solely by the scope of the following claims including equivalents thereof.

What is claimed is:

1. A method for impregnating an iron product with a hard wear-resistant material surface layer comprising:

(a) providing a pattern of particles arranged in a mesh plate;

(b) providing a sand core having a desired shape which has a first layer of adhesive on at least a portion thereof;

(c) placing a tape having a second adhesive layer onto the mesh plate so as to transfer the pattern of particles from the mesh plate onto the second adhesive layer and then placing the tape upon the first adhesive layer in a manner so as to minimize contact with the first adhesive layer;

(d) curing the first adhesive layer so as to anchor the particles to the sand core and then removing the tape; and (e) casting an iron melt around the particles so as to produce an iron product having a wear-resistant material surface layer.

2. The method according to claim 1 wherein the pattern of particles of (a) is obtained by (i) providing a mesh plate having a desired pattern of holes of a predetermined size;

(ii) spreading particles on the mesh plate so as to provide a particle in substantially all of the holes.

3. The method according to claim 2 wherein the particles are spherical particles having a mean diameter of at least about 2 mm.

4. The method of claim 3 wherein the particles have a mean diameter of about 2 to 3 mm.

5. The method according to claim 4 wherein the diameters of each of the particles are within about 0.5 mm of the median diameter.

6. The method according to claim 2 wherein the mesh plate thickness is between about ½ and about ¾ of the median diameter of the particles.

7. The method according to claim 2 wherein said iron product comprises ductile iron.

8. The method according to claim 2 wherein the wear-resistant material comprises tungsten carbide.

9. The method according to claim 8 wherein the tungsten carbide includes about 12 wt % Co.

10. The method according to claim 2 wherein the adhesive comprises a high temperature adhesive.

11. The method according to claim 10 wherein the high temperature adhesive comprises an inorganic high temperature adhesive.

12. The method according to claim 2 further comprising (f) cooling the product and separating both the adhesive and the core from the iron product and (g) finishing the hard wear-resistant surface.

13. A method for impregnating an iron product with a hard wear-resistant material surface layer comprising:

(a) providing a sand core having a desired shaped which is a layer of adhesive on at least a portion thereof;

(b) placing a flexible mesh plate having a desired pattern of holes of a predetermined size on the adhesive layer;

(c) spreading particles on a mesh plate so as to provide a particle in substantially all holes wherein the mesh plate and particles are selected so as to minimize contact between the particles and the adhesive;

(d) curing the adhesive so as to anchor the particles to the sand core;

(e) removing the mesh plate; and (f) casting an iron melt around the particles so as to produce an iron product having a wear-resistant material surface layer.

14. The method according to claim 13 wherein the particles are spherical particles having a mean diameter of at least about 2 nm and the mesh plate has a thickness between about ½ and about ¾ of the median diameter of the particles.

15. The method according to claim 13 wherein said iron product comprises ductile iron, the wear-resistant material comprises tungsten carbide and the adhesive comprises a high temperature adhesive.

16. The method according to claim 13 further comprising:

(g) cooling the product and separating both the adhesive and the core from the iron product; and (h) finishing the wear-resistant surface.

* * * * *

UNITED STATES PATENT AND TRADEMARK OFFICE

CERTIFICATE OF CORRECTION

PATENT NO. : 5,190,092

DATED : March 2, 1993

INVENTOR(S) : Gopal S. Revankar

It is certified that error appears in the above-indentified patent and that said Letters Patent is hereby corrected as shown below:

Column 6, line 47, Claim 13, delete "shaped' and insert --shape--.
Column 6, line 66, Claim 14, delete "nm" and insert --mm--.

Signed and Sealed this

Thirty-first Day of May, 1994

Bruce Lehman

*Attest:*

BRUCE LEHMAN

*Attesting Officer*

*Commissioner of Patents and Trademarks*